United States Patent [19]

DeDiemar et al.

[11] Patent Number: 4,989,797

[45] Date of Patent: Feb. 5, 1991

[54] SINGLE SWING JAW CRUSHING APPARATUS WITH AN UNOBSTRUCTED FEED OPENING

[76] Inventors: Ronald B. DeDiemar, 3401 Vera Cruz Dr., San Ramon, Calif. 94583; R. Reid Greenlaw, 56 Claremont Ave., Orinda, Calif. 94563; F. Curtis Archer, S. 5518 Cree Dr., Spokane, Wash. 99206

[21] Appl. No.: 339,956

[22] Filed: Apr. 17, 1989

Related U.S. Application Data

[63] Continuation of Ser. No. 120,822, Nov. 16, 1987, abandoned.

[51] Int. Cl.[5] ..... B02C 1/04

[52] U.S. Cl. ..... 241/264; 241/265; 241/287

[58] Field of Search ..... 241/262, 263, 264, 265, 241/266, 267, 268, 269, 198 A, 286, 287, 101.2

[56] References Cited

U.S. PATENT DOCUMENTS

| | | | |
|---|---|---|---|
| 2,326,215 | 8/1943 | Gruender | 241/267 |
| 4,244,532 | 1/1981 | Kroening et al. | 241/264 |

*Primary Examiner*—Joseph M. Gorski

[57] ABSTRACT

A jaw-type rock crusher has a stationary jaw, a cantilevered swing jaw driven by a toggle drive system, and a top feed opening above the crushing chamber formed between the two jaws. Two lateral hinge supports having an elevated horizontal hinge axis which lies in a plane generally bisecting the crushing chamber hingedly engage lateral support arms forming the upper hinge section of the swing jaw. In accordance with the invention, the lateral hinge supports and the swing jaw's upper support arms straddle the frame of the crusher and its top feed opening to allow the top feed opening to extend behind the swing jaw's hinge axis thereby permitting larger rock to be fed into the crusher and permitting easier access into the crusher for the purpose of dislodging or breaking up over-sized rock. A shock-absorbing back wall positioned behind the hinge axis near the top of the crusher prevents the impact forces of rock fed into the feed opening at high velocities from being fully absorbed by the swing jaw's bearings.

In the preferred embodiment, the swing jaw is fabricated in three sections, namely, an upper hinge section formed by the two lateral support arms of the jaw, a lower jaw section, and an elongated joining member for attaching the upper and lower jaw sections at a desired and precise adjusted angle which permits the lower end of the jaw to be properly aligned with their crusher's toggle drive system.

20 Claims, 6 Drawing Sheets

SINGLE SWING JAW CRUSHING APPARATUS WITH AN UNOBSTRUCTED FEED OPENING

This application is a continuation of application Ser. No. 07/120,822, filed Nov. 16, 1987.

BACKGROUND OF THE INVENTION

The present invention generally relates to a single swing jaw-type of crushing apparatus wherein rocks or other crushable materials are crushed in a crushing chamber formed below a top feed opening between a large stationary jaw and an oscillating swing jaw. The invention more particularly relates to a single swing jaw crusher having a cantilevered swing jaw design for producing purely compressive crushing forces between the jaws.

Single swing jaw-type rock crushers are well-known and have been used for many years. The basic principal of such crushers is to gravity feed rocks or other crushable materials into a crushing chamber situated between two massive jaws, one and only one of which is a swing jaw driven in a rapid oscillatory motion (generally in the range of 300–400 r.p.m.) about an elongated hinge pin. Conventional swing jaw designs differ in that they include cantilevered designs (sometimes referred to as "gooseneck" swing jaws) and straight jaw designs. In both cases, the swing jaw's hinge structure extends all the way across the top of the crusher whereby the crusher's top feed opening through which crushables are fed into the crushing chamber is formed in the region forward of the swing jaw's hinge axis.

A major difficulty with cantilevered swing jaw designs is that the swing jaw's hinge pin is cantilevered inwardly at the top of the crusher, so that the hinge pin and swing jaw structure itself obstruct the feed opening of the crusher. There is a tendency by users to feed rocks into a crusher which are too large for the crusher to handle and which have to be removed from the feed opening or broken up manually. In large capacity machines where oversized rocks typically range from four to ten tons, auxiliary machines, such as large pneumatic jack hammers, must be used for this purpose. Where access through the feed opening is restricted by the swing jaw hinge structure, as in cantilevered swing jaw designs, it is difficult to insert the ends of these devices at angles which will efficiently accomplish their task.

The above disadvantage of cantilevered swing jaw designs are not generally present in straight swing jaw crushers, such as the Blake-type and overhead eccentric-type crushers. Such crushers have a swing jaw extending in a straight line at a downward angle from its overhead full length hinge. Unlike the cantilevered jaw design, their jaw hinge is generally situated more toward the back of the crusher and therefore the hinge structure does not create a substantial obstruction at the feed opening.

However, there are known and significant disadvantages with straight jaw designs. In the Blake-type crusher, which has a toggle drive at the bottom of the jaw, the motion of the swing jaw forces rock upward, causing it to rub against the jaws and to rapidly wear down the jaw plates; there is also essentially no motion of the jaw at the top of the crushing chamber. In the overhead eccentric-type of crusher, wherein the jaw is driven at its top end by an eccentric bearing, the moving jaw forces rock both up and down with similar results. With the cantilevered swing jaw design, the hinge axis for the swing jaw lies on a plane bisecting the crushing chamber so that a straight line and purely compressive crushing force is produced. This substantially reduces jaw plate wear, and generally permits the swing jaw to operate at more strokes per minute for greater capacity and to do so with less power consumption. Thus, despite the fact that the hinge pin of the inwardly cantilevered swing jaw limits the size of the feed opening to an area forward of the jaw's hinge axis, the cantilevered design provides significant advantages which have led to their widespread use.

A single swing jaw crusher of the above described cantilevered construction is shown in U.S. Pat. No. 4,398,674, to George S. Dremann, wherein it can be seen that the feed opening forward of the swing jaw's hinge pin would generally make the removal of oversized material from the crushing chamber very difficult.

The present invention provides a single swing jaw rock crushing apparatus which has a cantilevered swing jaw design such as shown in the Dremann patent (that is, a single swing jaw crusher with its swing jaw hinge axis over the crushing chamber), but which overcomes the problem encountered by prior cantilevered jaw designs, that of having a restricted feed opening. In the present invention, an enlarged feed opening is provided without sacrificing the advantages of the cantilevered jaw design, namely, extended jaw plate wear, greater capacity, and lower power consumption. The present invention also provides a cantilevered single swing jaw crusher wherein the feed opening can more readily be accessed by percussive devices for breaking up oversized rock, and wherein the cantilevered swing jaw is comparatively easy to manufacture and assemble with a proper jaw angle.

SUMMARY OF THE INVENTION

The single swing jaw crushing apparatus of the invention is comprised of a stationary frame having a top feed opening and a swing jaw with cantilevered upper hinge and lower jaw sections. The lower jaw section of the swing jaw is carried within the stationary frame such that a gravity fed crushing chamber is formed between it and an opposing stationary jaw, and hinge support means for the swing jaw are situated at the top of the stationary frame so that the hinge axis of the swing jaw is elevated a substantial distance above the top of the crushing chamber to develop proper crushing forces throughout this chamber, and so that the hinge axis also lies in a plane passing through the crushing chamber as required to develop straight line crushing forces. In accordance with the invention, the upper hinge section of the swing jaw and the hinge means therefor are so formed and so positioned as to allow the feed opening to extend through and behind the swing jaw's hinge axis.

In accordance with the illustrated embodiment, the hinge means for the swing jaw consists of two, separate lateral hinge supports mounted to the top of the side panel structures of the stationary frame so as to straddle the frame's top feed opening. Two lateral support arms straddling the stationary frame's lateral side panel structures form the upper hinge section of the swing jaw which hingedly engages the lateral hinge supports. By having the hinge support means and the upper hinge section of the swing jaw straddle the crusher's feed opening and frame, the top region within the crusher near the hinge axis of the swing jaw will be clear of obstructing structural elements.

In prior crusher designs, the entire cantilevered swing jaw of a single swing jaw crusher is fabricated as a unitary structure having a heavy box beam construction. With such a unitary construction, there is no capability for final adjustments to correct for any misalignment of the bottom of the jaw and the seat for its toggle drive element. In the preferred embodiment of the present invention, the cantilevered swing jaw is fabricated in parts. Specifically, the lateral support arms and lower jaw section of the swing jaw are joined together by means of an elongated joining member attached intermediate its ends to the upper end of the lower jaw section. During assembly, the lateral support arms are suitably attached such as by welding to the two joining member ends which extend to the outside of the stationary frame's side panel structures. This attachment is made so as to provide an adjusted angle between the swing jaw's upper hinge and lower jaw sections to properly and precisely position the bottom end of the swing jaw relative to the toggle drive mechanism which, as more fully described below, drives the bottom end of the jaw. It is contemplated that the elongated joining member can be a metal tube or have other cross-sectional shapes, and that the swing jaw will be assembled and installed during the final stages of assembly of the crushing apparatus.

In a further aspect of the invention, a shock-absorbing back wall means is provided between the side panel structures of the stationary frame and behind the swing jaw's lateral hinge supports. In normal operation, rocks will frequently be fed into the feed opening of the crusher at high velocity and with a horizontal trajectory which causes the rock to strike the structure of the crusher below and at the back of the feed opening. In prior designs, rocks would directly strike the top hinge section of the swing jaw imparting tremendous impact forces to the swing jaw bearings. The shock-absorbing wall means of the present invention is provided to absorb these impact forces and to reduce the frequency of bearing replacement.

In the illustrated embodiment, the shock-absorbing wall means at the back of the feed opening is comprised of an impact plate hingedly attached at its upper end to the stationary frame, and a resilient stop means for the bottom free of the impact plate secured to the swing jaw or to the impact plate itself. Such a shock-absorbing wall means would tend to absorb the impact of incoming projectiles by the recoiling action of the impact plate about its hinge mount on the stationary frame.

Therefore, it can be seen that a primary object of the present invention is to provide a single swing jaw crushing apparatus having a cantilevered swing jaw design which does not obstruct the feed opening of the crusher. It is a further object of the invention to provide a swing jaw design that is comparatively easy to manufacture and assemble to specifications that permit precise alignment of the end of the jaw with the jaw's toggle drive parts. It is still a further object of the invention to provide such single swing jaw crusher design wherein the impact forces of high velocity projectiles fed through the feed opening of the crusher are absorbed to reduce wear on the swing jaw bearings.

Still further objects of the invention will be apparent from the more detailed description of the embodiments of the invention illustrated in the accompanying drawings.

DETAILED DESCRIPTION OF THE ILLUSTRATED EMBODIMENT

Figure 1:
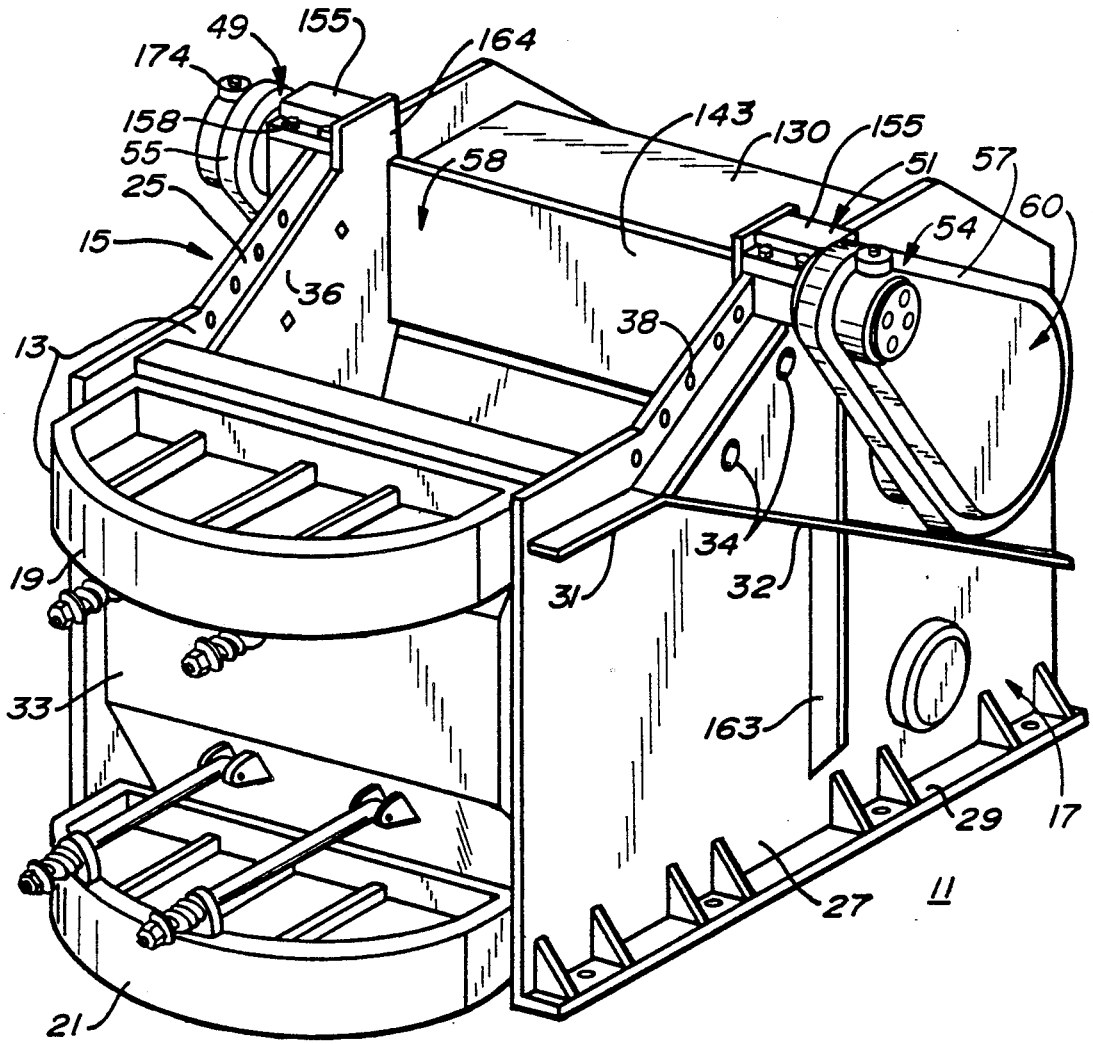
FIG. 1 is a perspective view of a single swing jaw crushing apparatus made in accordance with the present invention.
Figure 2:
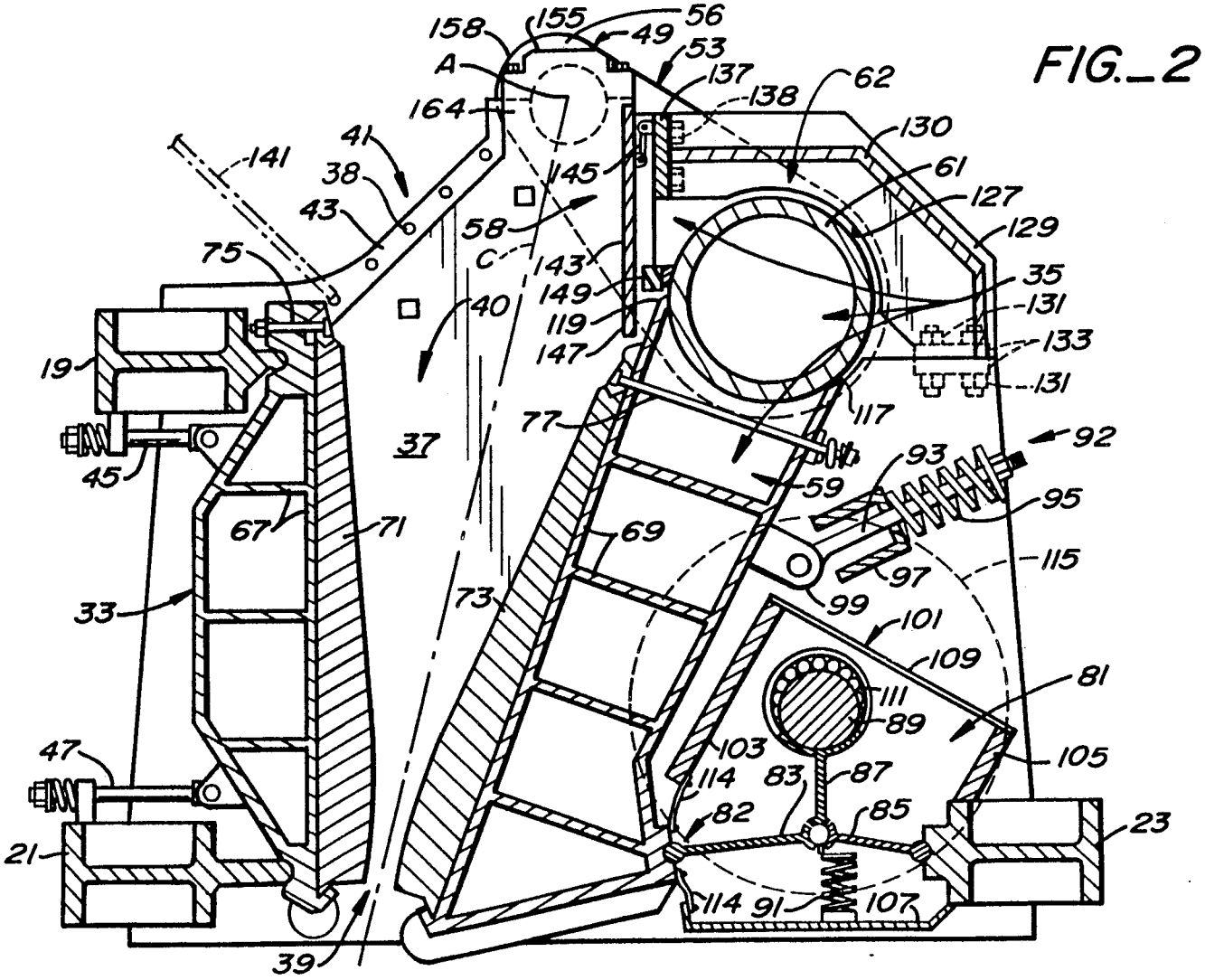
FIG. 2 is a cross-sectional view in side elevation of the single swing jaw crushing apparatus shown in FIG. 1.

Referring now to the drawings, FIGS. 1 and 2, which best illustrate the overall construction of the invention, show a single swing jaw crushing apparatus, generally denoted by the numeral 11, wherein crushing occurs within a large and massive stationary frame 13. The stationary frame has horizontal front and back strong back members 19, 21, 23 extending between two lateral side panel structures 15, 17 comprised of steel side plates 25, 27, bottom outside footings 29 used for bolting the crushing apparatus to wood skids or a platform, and exterior beam weldments 31 for reinforcement. To provide a steel frame of suitable strength to withstand the impact forces produced by the operating crusher, the frame should be welded together and stress relieved before machining.

Referring to FIG. 2, the stationary frame is seen to carry two opposed and generally vertically oriented jaws 33, 35. A gravity fed and generally vertically aligned crushing chamber 37 is formed between the jaws and tapers from a top end 40 down to a narrow discharge end 39 at the bottom of the crushing apparatus. This chamber receives rock or other crushable materials fed through a top feed opening 41 located at the top of the stationary frame and in part defined by the angled top edges 43 of the side plates 25, 27 of the frame's side panel structures. The width of the top feed opening generally corresponds to the separation of the steel side plates 25, 27, while the longitudinal dimensions of the top feed opening are generally delimited by the structural elements surrounding the top of the two opposing jaws, as will be more fully described below. As earlier stated, it is one of the objects of the present invention to maximize the size of this top feed opening to permit larger rocks to be introduced into the tapered crushing chamber and to facilitate access to the crushing chamber for dislodging or manually breaking up oversized rocks.

To suitably reinforce the top of the side plates 25, 27 near the feed opening, the weldments 31 on the side plates include a triangularly shaped box beam structure 32 on the top front portion of the side plates which bounds the feed opening 41. Pipe chases 34 extend through the box beam structure to accommodate plough bolts used to secure replaceable wear plates 36 on the inside of the steel side plates. Bolt holes 38 can be suitably provided in the side plates above the inside wear plates to permit attachment of an infeed chute over the feed opening.

Of the two opposing jaws 33, 35, the jaw 33 shown to the left of FIG. 2 is a static or stationary jaw immovably held back against the frame's upper and lower front strong back members 19, 21 by means of spring loaded retention bolts 45, 47; the jaw 35 shown to the right of FIG. 2 is a cantilevered swing jaw hingedly suspended from the top of the crushing apparatus by hinge support means comprised of two lateral hinge supports 49, 51 mounted at the top of the stationary frame on a common horizontal hinge axis A. As best seen in FIG. 2, the hinge axis, being at the top of the crusher frame, is elevated a substantial distance above the top end 40 of the crushing chamber This elevated position of the hinge axis permits the entire lower jaw section of the swing jaw to travel in a sufficient arc when the swing jaw pivots about the hinge axis to produce a substantial crushing action throughout the chamber, that is, in the chamber's top end 40 as well as its bottom end 39. The upper hinge section 53 of the swing jaw consists of two lateral support arms 55, 57 which hingedly engage the lateral hinge supports on the outside of the side panel structures 15, 17. It is seen that in contrast to the unitary hinge and jaw structure of prior designs, the invention's lateral support arms and their lateral hinge supports straddle the crusher frame at the frame's top feed opening rather than obstruct the top region 58 between the frame's side panels beneath and to the rear of the hinge axis A. The top feed opening, as expanded, is now essentially defined to include top region 58, with the forward part of the feed opening being further defined by the top structure of the stationary jaw 71 and the top edges 43 of the frame's side plates which are seen to extend generally from the hinge axis down to the top of the stationary jaw.

Figure 4:
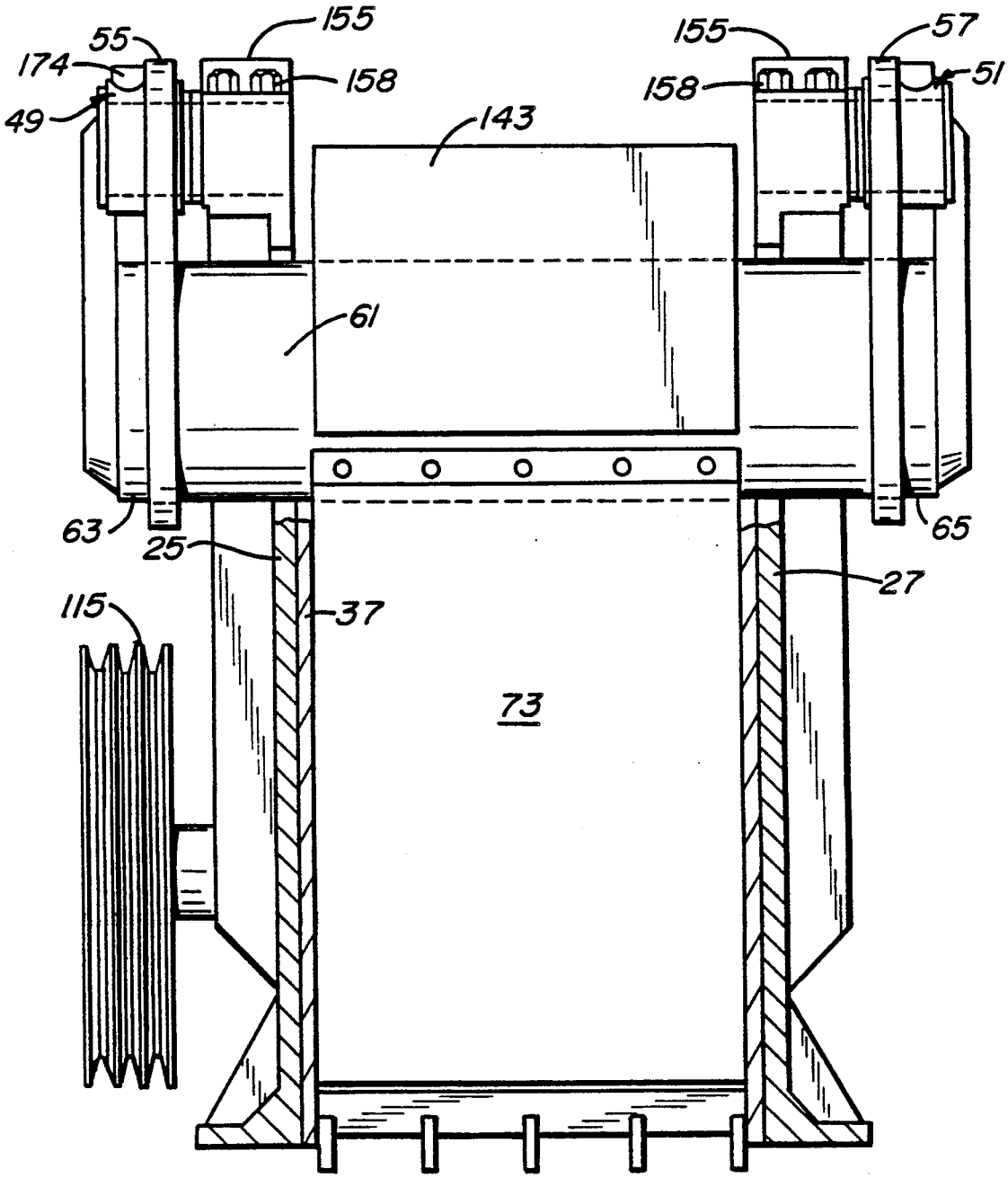
FIG. 4 is a representational view of the single swing jaw apparatus of FIG. 2 taken generally along the plane "C", showing generally the lateral positioning and arrangement of the upper support arms, the lower jaw section, the joining member for the swing jaw, and the impact plate of the shock-absorbing back wall means.

The swing jaw also has a lower jaw section 59 which opposes the stationary jaw to form the crushing chamber 37. As best seen in FIG. 4 and as more fully described below, the lower jaw section, which is disposed between the frame's side panel structures, is joined to the joint ends 60, 62 of the lateral support arms located on the outside of the side panels by means of an elongated joining member in the form of a steel tube 61 having laterally extending ends 63, 65.

As shown in FIG. 2, both the stationary jaw and lower jaw section of the swing jaw have jaw plates 71, 73, of a suitably hard material, such as Hadfields manganese steel. Retention bolts, such as the illustrated retention bolts 75, 77, removably hold the jaw plates to their supporting jaw frames 67, 69 so that they can periodically be replaced. Similarly, the wear plates 36 secured to the inside of the steel side plates 25, 27, serve as a replaceable lining for the sides of the crushing chamber.

As further illustrated in FIG. 2, the swing jaw is driven about its hinge axis by a toggle drive system, generally denoted by the numeral 81, which engages the back of the lower end of the swing jaw at the toggle seat 82 and which drives the swing jaw in a rapid short oscillatory motion caused by the pivoting action of toggle plates 83, 85. The toggle plates are reciprocated by a pitman 87 held against the lower side of a rotating eccentric shaft 89 by means of a compression spring 91 disposed beneath the toggle plates; a further jaw retention element 92, comprised of a retention rod 93 and a compression spring 95 reacting against bracket members 97 of the stationary frame, attaches to a bracket 99 on the back of the swing jaw's lower jaw section to hold the lower jaw section against the inner toggle plate 83. It can be seen that the toggle drive parts will be held firmly together by the forces of the outer toggle plate 85 bearing against the lower right-hand strong back member 21, and the combined forces of the lower compression spring 91 and retention element 93.

The toggle drive system is enclosed within a housing 101, two sides of which are formed by angled cross walls 103, 105 extending between the frame's steel side plates 25, 27. An oil pan 107 is secured below the housing, and a removable cover plate 109 which permits quick and easy access to the toggle drive mechanism is secured to the top. Heavy duty self-aligning roller bearings 111 mounted in line-bored bearing housings 110 in the steel side plates carry the eccentric shaft 89. For lubrication of the shaft's roller bearings and other parts of the toggle drive system, an oil bath is provided in the housing by a suitable oil recirculating system (not shown). A flexible diaphragm 114 provides a fluid seal between the swing jaw's toggle seat 82 and inner housing wall 102 and the oil pan 107.

The toggle drive system is powered by an external drive motor (not shown) belted directly to the flywheel 115. The flywheel would normally be provided with a mechanical safety release of a known design such that with a pre-set amount of over-pressure the flywheel "kicks out" to a free-wheeling condition, removing the drive power from the eccentric shaft and thereby shutting down the crushing action of the apparatus. Such over-pressure is often caused by a non-crushable material being introduced into the crushing chamber 37, such as tramp iron which after shutdown is removed from the crushing chamber by a long crowbar or pneumatic device capable of being inserted into the crushing chamber through the feed opening. As above-mentioned, the relative difficulty of accessing the crushing chamber will be affected by the size of the feed opening, and by providing a larger unobstructed feed opening in accordance with the invention access to the crushing chamber will be facilitated.

In reference to the assembly of the swing jaw of the invention, the steel tube 61 forming the elongated joining member for the upper hinge and lower jaw sections of the swing jaw will have sufficient length to extend beyond the side panel structures of the stationary frame. It will be appreciated that while the steel tube is shown as having an outside diameter roughly equal to the width of the top of the jaw frame, the invention is not so limited. For example, it may be desirable to increase the width of the jaw frame relative to the tube diameter in order to increase the mass of the swing jaw. In such a case the gap between the tube and jaw frame can be bridged by a suitable welded in rib structure.

During assembly, the steel tube 61 is welded at 117, 119 across the top of the upper end of the swing jaw frame 69, and after adjusting for a proper angulation of the lower jaw section to the support arms, the extended ends of the tube 63 are then welded to the joint ends 60, 62 of the support arms. By providing a swing jaw which is welded together in sections, manufacture and assembly of the swing jaw to proper specifications is substantially simplified as compared to manufacturing the jaw as a unitary structure. This is because adjustment of the jaw angle can be made during final assembly to align the toggle seat 82 with the end of the toggle plate 83. Unless these parts are precisely aligned, the oscillatory motion of the swing jaw will cause tearing in the diaphragm 114.

Figure 2A:
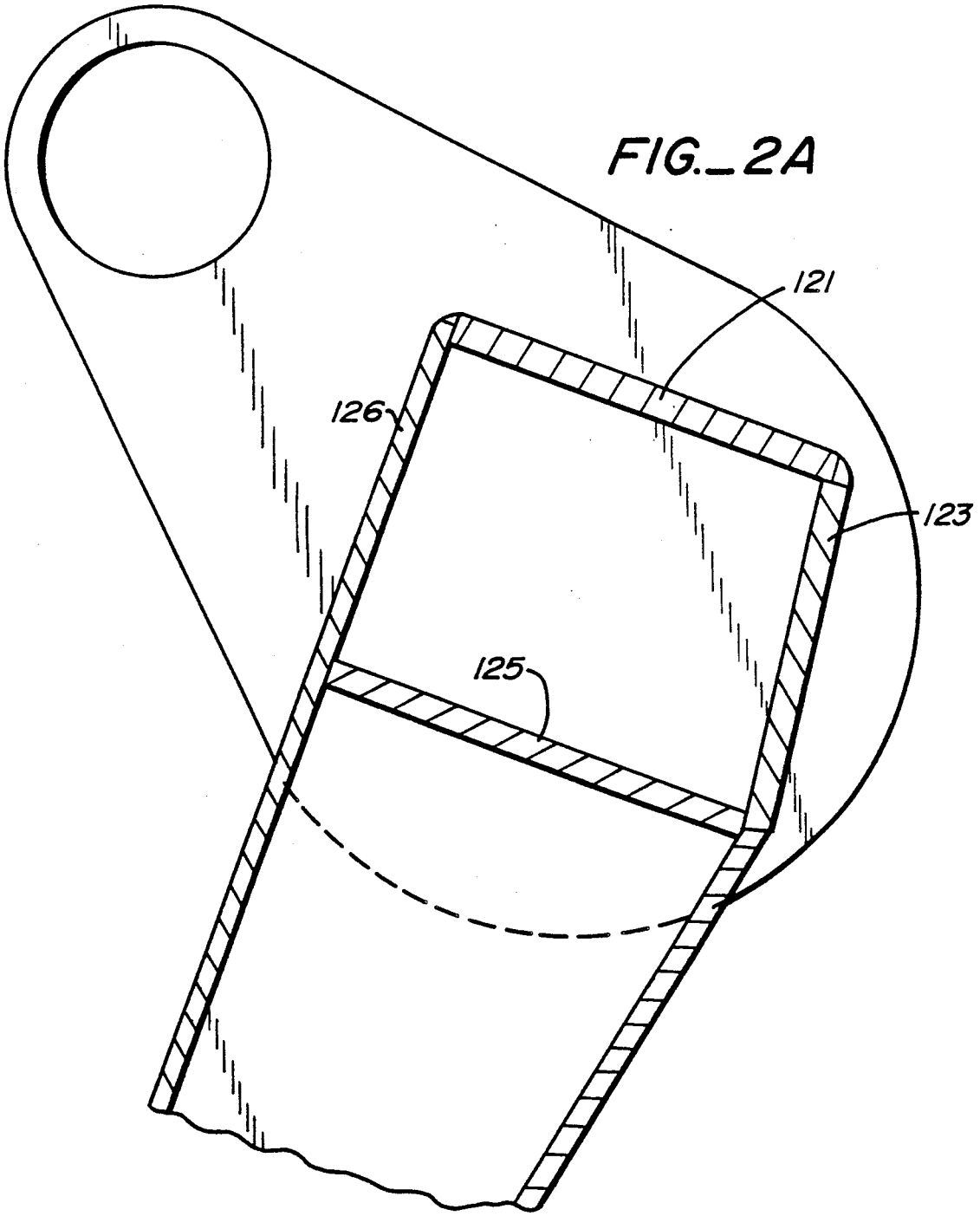
FIG. 2A is a partial cut-away view of a swing jaw made in accordance with the invention, showing an alternative construction and assembly of the joining member connecting the upper support arms and lower jaw section of the swing jaw.
Figure 3:
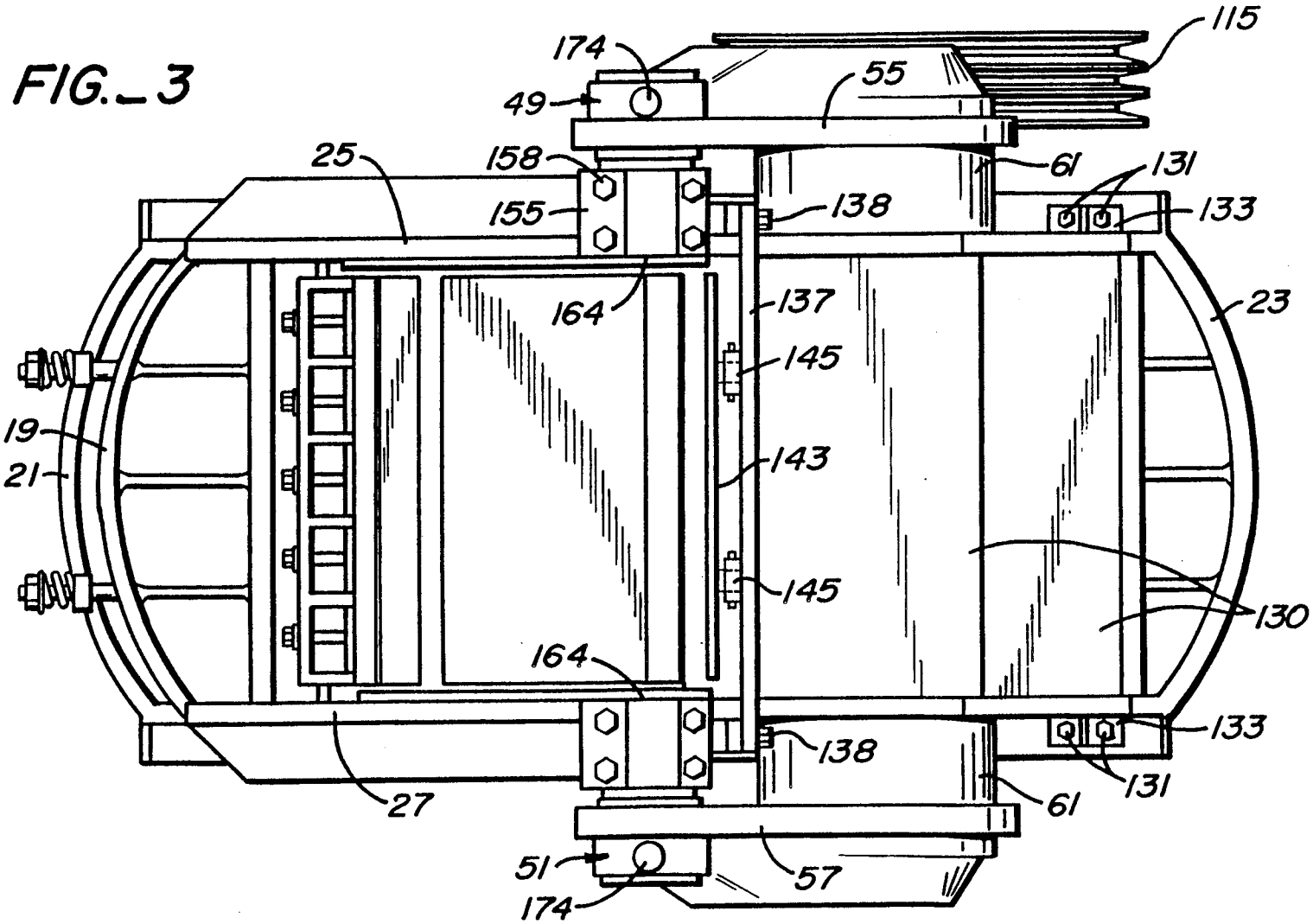
FIG. 3 is a top plan view of the single swing jaw apparatus shown in FIGS. 1 and 2.

FIG. 2A shows an alternative configuration for the joining member of the swing jaw wherein, instead of a cylindrical tube as shown in FIG. 2, a generally box-shape joining member is fabricated from elongated steel plates 121, 123, 125 welded to the upper end of the lower jaw section. As illustrated in FIG. 2A, the front wall 126 of the jaw frame extends upwardly to provide a front wall to the joining member between the side panel structures of the stationary frame. On the outside of the side panel structures, the laterally extending ends of the elongated steel plates 121, 123, 125 form three sides of the extended ends of the joining member's box structure; separate short steel plate sections (not shown) can be used to enclose the box structure on the outside of the side panels.

The swing jaw in accordance with FIG. 2A is assembled in a manner similar to the swing jaw of FIG. 2, in that, the lower jaw section is first fabricated by welding its parts together, and then the extended box ends of the box-shape joining member are welded in a proper rotational orientation to the lower ends of the support arms.

It will be appreciated that the opening 127 in the side panel structures through which the joining member extends to engage the support arms needs to suitably be sized to provide enough clearance to not only allow the joining member to swing freely, but to prevent pinch points, that is, small gaps in which fingers of a hand can be injured. For conventionally sized machines, the amplitude of the movement of the swing jaw at this junction would likely be roughly plus or minus one-quarter of an inch. A clearance of about one and one-half inches is believed to be suitable to prevent pinch points.

As best shown in FIG. 2, the stationary frame of the crusher includes a removable steel buttress 129 having a back cover plate 130 which encloses the area behind the joining member of the swing jaw. This steel buttress, which is attached at its lower end to a cross beam 133 by securement bolts 131, and at its upper end to flanges 134 situated at the top of the vertical edge 135 of the steel side plates, can be removed for installing the swing jaw in the stationary frame. The buttress also provides an upper cross member 137 from which a shock-absorbing wall means can be anchored as described below.

As above-mentioned, rock is fed into the crushing apparatus' feed chamber through the top feed opening 41. This rock is typically fed through the feed opening from an infeed chute 141 which can in turn be loaded from a conveyor system or directly from large earth digging or hauling machinery or vehicles. The rock will normally slide in on the chute at relatively high velocities in a sufficiently horizontal direction to cause the rock to strike the swing jaw structure opposite the chute. In order to absorb the impact force of the incoming rock and to prevent the large impact forces from being transmitted directly to the bearings of the lateral hinge supports, a shock-absorbing back wall means is provided in front of the swing jaw's joining member and the upper part of the lower jaw section of the swing jaw.

As best illustrated in FIG. 2, the shock-absorbing back wall means is comprised of a vertical impact plate 143 attached to the cross member 137 of buttress 129 near the top of the stationary frame by means of double hinges 145 which allow for rebound movement at the top of the plate. The impact plate depends from its double hinge axis downwardly to a position where its free end 147 is situated near the top of the lower jaw section, thus covering the swing jaw joining member 61. A resilient stop means in the form of a rubber block 149 or other resilient material is secured to the joining member to provide a stop for the free end of the impact plate. Thus, it can be seen that high velocity rocks fed through the feed opening at a high horizontal trajectory will strike the impact plate which in turn will largely deflect the impact force by hingedly recoiling against the shock-absorbing rubber block.

It is contemplated that a shock-absorbing wall means can be implemented in other ways, for example, by securing the rubber block to a second lower cross member welded to the stationary frame whereby the force of the recoiling impact plate is transmitted directly to the stationary frame.

Figure 5:
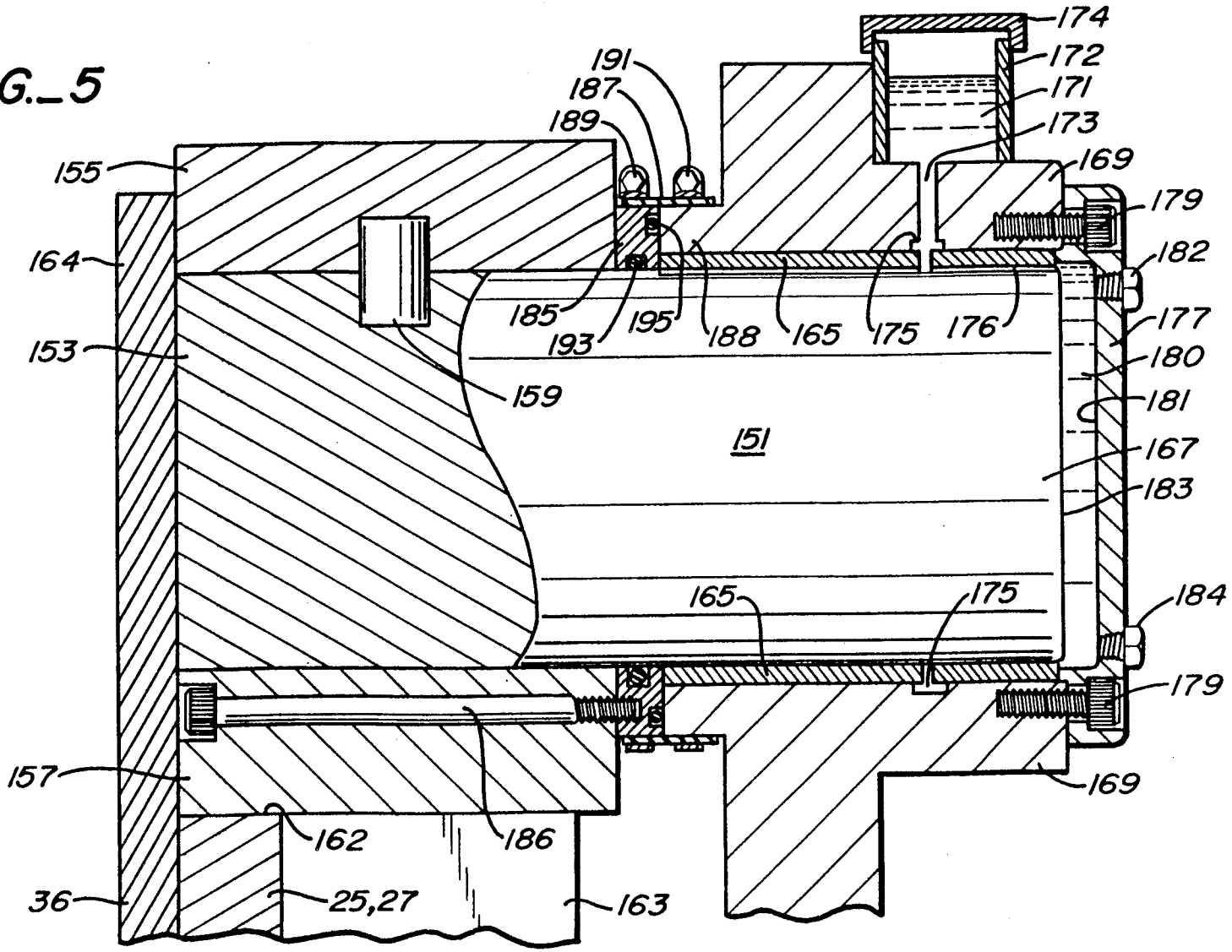
FIG. 5 is a cross-sectional view in side elevation of a lateral hinge support for the swing jaw of the invention.

FIG. 5 shows one of the lateral hinge supports to which the support arms 55, 57 of the swing jaw are hingedly attached. The lateral hinge supports are mounted on an elevated hinge axis "A", which, in order to provide suitable straight line crushing forces falls on a center plane (denoted by the letter "C" in FIG. 2) passing through the crushing chamber. By providing lateral hinge supports which are secured to the outside of the side panel structures of the stationary frame, the top feed opening of the stationary frame is effectively expanded to include the region between the lateral hinge supports and forward of the impact plate 143. Because of this, the center plane on which the hinge axis of the lateral hinge supports fall will also pass through the top feed opening of the apparatus. In conventional single swing jaw rock crushers which have a continuous hinge pin obstructing the top feed opening, the feed opening's longitudinal dimension is constrained to an area forward of the hinge axis, effectively reducing the vertical opening by roughly thirty percent.

With further reference to FIG. 5, the lateral hinge supports 49, 51 are single shear hinge supports having a short hinge pin 151 clamped in a fixed horizontal position at its interior end 153 by a hinge block 155 suitably attached to the top edge of the steel side plates 25, 27 of the stationary frame's side panel structures, such as by welding the base 157 of the hinge blocks to the top edge 162 of the side plates (see FIG. 1) and to the top of the vertical support beam 163 of the exterior beam weldments 31. A keeper pin 159 in the hinge block cover 160 acts to hold the hinge pin 151 in a rotationally fixed position and the side wear plates 36 have a top extension 164 for protecting the interior end of the hinge pin from being damaged or knocked loose by incoming rock.

The lateral hinge supports 49, 51 each include a sleeve bearing 165, suitably a bronze sleeve bearing, disposed in the bearing hub 169 formed at the hinged end of each of the swing jaw's support arms. (It can be seen that the support arms of the swing jaw hingedly engage the outer end 167 of the hinge pin at their bearing hubs.) Means in the bearing hubs are provided for lubricating the sleeve bearing. Specifically, a lubricant reservoir 171 is provided which fluidly communicates with annular and longitudinal fluid channels 175, 176 in the sleeve bearing through passage 173. This fluid reservoir can suitably consist of a threaded pipe section 172, e.g., 2½ inch pipe welded to the top of the bearing hub and a threaded pipe cap 174 which can easily be removed for cleaning the reservoir. A further auxiliary reservoir 180 is provided at the outer end 167 of the hinge pin by a recess 181 in the outer end cap 177 secured to the end of the bearing hub by means of bolts 179. This auxiliary fluid reservoir, which additionally provides a lubricating point at the outside end surface 183 of the hinge pin, supplies lubricant to the sleeve bearing directly through the sleeve's longitudinal fluid channel 176. Suitable vent and drain plugs 182, 184 can be provided in the end caps 177 whereby the auxiliary reservoir can be drained and vented.

The bearing hubs 169 of the movable support arms are sealably coupled to the immovable inner hinge block 155 by means of an intermediate stationary bronze thrust washer 185 secured by lag bolts 186 and an elastomeric diaphragm 187 overlapping the thrust washer and an adjacent shoulder 188 on the inside diameter of the support arm hub. Hose clamps 189, 191 firmly clamp the elastomeric diaphragm into place, and O-rings 193, 195 provide a fluid seal between the thrust washer, hinge pin, and hub.

The foregoing seal construction is designed to provide a self-lubricating bearing structure for the swing jaw lateral hinge supports, one which seals out foreign particles which can damage the sleeve bearing and which will hold up over an extended period of time under the extreme load conditions presented by the oscillatory movement of the massive swing jaw. It will be understood that other bearing structures could be provided. One example would be to use a roller bearing instead of a mechanical sleeve bearing. However, the load distribution on the bearing surfaces of a roller bearing is inferior to that of a sleeve bearing and therefore the roller bearing would tend to wear out faster. Another example would be a spherical sleeve bearing wherein spherical contact surfaces would permit lateral movement of the support arms as well as rotational movement. Theoretically, such a bearing would be superior to the straight sleeve bearing of the illustrated embodiment, however, it would be considerably more expensive to implement.

Therefore, it can be seen that the present invention provides for an improved rock crushing apparatus having a cantilevered swing jaw design wherein the swing jaw of the apparatus can be assembled with greater ease than is the case with conventional unitary cantilevered swing jaw designs. In contrast to the continuous hinge pin construction of conventional crushers, the swing jaw of the invention has an elevated lateral support arm construction and lateral hinge supports which provide an expanded feed opening for the crusher, providing better access to its crushing chamber. It is also seen that a rock crushing apparatus in accordance with the invention will take up the impact forces of incoming rocks in a manner which improves the life of the swing jaw bearings. Although the present invention has been described in considerable detail in the foregoing specification, it will be understood that the invention is not to be limited to such detail, except as it necessitated by the following claims.

We claim:

1. A single swing jaw crushing apparatus with an unobstructed feed opening comprising a stationary frame having a top feed opening and opposed side panel structures, the separation of which substantially defines the width of said top feed opening, a cantilevered swing jaw having an upper hinge section and a lower jaw section, a stationary jaw, said stationary jaw and the lower jaw section of said swing jaw being positioned in opposition to each other within said stationary frame such that a gravity fed crushing chamber having a top end and bottom discharge end is formed therebetween below said top feed opening, lateral hinge supports straddling the top feed opening of said stationary frame and hingedly holding the upper hinge section of said swing jaw to said stationary frame on a hinge axis, and means for driving said swing jaw about said axis in an oscillatory crushing motion, said hinge axis being elevated a substantial distance above the top end of said crushing chamber such that a substantial oscillatory crushing motion occurs in the lower jaw section of said swing jaw at the top end as well as the bottom end of said crushing chamber, said hinge axis being in a plane passing through said crushing chamber, and said upper hinge section of said swing jaw being comprised of upper lateral support arms which straddle said side panel structures of said stationary frame, so that said top feed opening extends through the hinge axis of said swing jaw.

2. The swing jaw apparatus of claim 1 wherein the upper lateral support arms of said swing jaw extend generally rearwardly and downwardly on the outside of the side panel structures of said stationary frame such that the upper hinge section of said swing jaw in no way obstructs the feed opening at the top of said stationary frame.

3. The swing jaw apparatus of claim 1 wherein a shock absorbing back wall means is attached to said stationary frame between said side panel structures and behind said lateral hinge supports.

4. The swing jaw of claim 3 wherein said shock absorbing wall means includes an impact plate having a free bottom end, said impact plate extending generally from near the top of said stationary frame generally behind the hinge axis of said swing jaw to near the top of the lower jaw section of said swing jaw.

5. The swing jaw apparatus of claim 4 wherein said stationary frame has an upper cross-member extending between said side panel structures behind the hinge axis of said lateral hinge supports and wherein said shock absorbing wall means includes at least one hinge device with a horizontal hinge axis for providing a hinge attachment between the top of said impact plate and the upper cross-member of said stationary frame, so that said impact plate will deflect about the horizontal hinge axis of said hinge device when struck by an incoming projectile fed through said feed opening.

6. The swing jaw apparatus of claim 5 wherein said hinge device is a double hinge.

7. The swing jaw apparatus of claim 5 wherein said shock absorbing wall means includes a resilient stop means for the free bottom end of said impact plate.

8. The swing jaw apparatus of claim 7 wherein said resilient stop means is comprised of a resilient material secured to said swing jaw generally behind the free bottom end of said impact plate.

9. The swing jaw apparatus of claim 7 wherein said cantilevered swing jaw includes joining means whereby the swing jaw's lateral support arms and lower jaw section are separate elements rigidly joined to each other during assembly of said swing jaw apparatus to form a swing jaw having a cantilevered angle adjusted during said assembly.

10. The swing jaw apparatus of claim 17 wherein said lateral support arms have defined lower ends and wherein said means for permitting the swing jaw's lateral support arms and lower jaw section to be assembled in sections at an adjusted cantilevered angle includes an elongated joining member attached to the upper end of the lower jaw section of said swing jaw, said elongated joining member having laterally extending ends which extend beyond the side panel structures of said stationary frame and which are rotationally attached to the lower ends of said lateral support arms.

11. The swing jaw apparatus of claim 10 wherein said joining member is a metal tube.

12. The swing jaw apparatus of claim 10 wherein said joining member is a metal elongated structure having a generally box-shaped cross-section.

13. The swing jaw apparatus of claim 1 wherein said side panel structures include opposed side panel plates each having an angled top edge which extends generally from said elevated hinge axis down to said stationary jaw whereby said top feed opening is generally defined by the angled top edges of said side plates, the top of said stationary jaw and the region between said hinge support means.

14. The swing jaw apparatus of claim 1 wherein the breadth of the top end of said crushing chamber is comparable to the breadth of said top feed opening whereby the top end of said crushing chamber can receive and crush crushables of a size that will fit through said top feed opening.

15. A single swing jaw crushing apparatus with an unobstructed feed opening comprising a stationary frame having opposed side panel structures and a top feed opening, the width of said top feed opening generally being defined by the separation of said side panel structures, a cantilevered swing jaw having an upper hinge section in the form of lateral support arms which straddle the opposed side panel structures of said stationary frame, a lower jaw section, and an elongated joining member for joining together said lateral support arms and said lower jaw section, said elongated joining member having laterally extending ends which extend beyond the side panel structures of said stationary frame and which are rotationally attached to the lateral support arms straddling said side panel structures to provide an adjusted fixed angle between the support arms and lower jaw section, a stationary jaw, said stationary jaw and the lower jaw section of said swing jaw being positioned in opposition to each other within said stationary frame such that a gravity fed crushing chamber is formed therebetween below said top feed opening, lateral hinge supports straddling said side panel structures for hingedly holding the lateral support arms of said swing jaw near the top feed opening of said stationary frame, said lateral hinge supports having a substantially horizontal hinge axis in a plane passing through said crushing chamber, shock-absorbing back wall means attached to said stationary frame between said side panel structures and behind said lateral hinge supports, and means for driving said swing jaw on said lateral hinge supports in an oscillatory motion.

16. The swing jaw apparatus of claim 13 wherein said shock absorbing wall includes an impact plate extending generally from near the top of said stationary frame generally behind said hinge axis to near the top of the lower jaw section of said swing jaw.

17. The swing jaw apparatus of claim 14 wherein said stationary frame has an upper cross member extending between said side panel structures behind said lateral hinge supports, and wherein said shock-absorbing wall means includes at least one double hinge device with the horizontal hinge axis for providing a double hinge attachment between the top of said impact plate and the upper cross member of said stationary frame whereby said impact plate will deflect about the horizontal hinge axis of said hinge device when struck by incoming projectiles fed through said feed opening.

18. The swing jaw apparatus of claim 13 wherein said gravity fed crushing chamber has a top end and a bottom discharge end and said hinge axis is elevated a substantial distance above the top end of said crushing chamber such that the lower jaw section of said swing jaw will have a substantial oscillatory crushing motion at the top as well as the bottom end of said crushing chamber.

19. The swing jaw apparatus of claim 18 wherein said side panel structures include opposed side panel plates having an angled top edge which extends generally from said elevated hinge axis down to said stationary jaw whereby said top feed opening is generally defined by the angled top edges of said side plates, the top of said stationary jaw and the region between said hinge support means.

20. A single swing jaw crushing apparatus having an unobstructed feed opening comprising a stationary frame having a top feed opening and two opposed side panel structures the separation of which substantially defines the width of said top feed opening, a cantilevered swing jaw having an upper hinge section and lower jaw section, a stationary jaw held to said stationary frame so as to be relatively immovable, said stationary jaw and the lower jaw section of said swing jaw being positioned in opposition to each other within said stationary frame such that a gravity fed crushing chamber having a top end and bottom discharge end is formed therebetween below said top feed opening, the top end of said crushing chamber having a breadth comparable to the breadth of said top feed opening, lateral hinge supports straddling the top of said stationary frame and hingedly holding the upper hinge section of said swing jaw to said stationary frame on a hinge axis, means for driving said swing jaw about said hinge axis in an oscillatory crushing motion, said hinge axis being elevated a substantial distance above the top end of said crushing chamber such that a substantial oscillatory crushing motion occurs in the lower jaw section of said swing jaw at the top end as well as the bottom end of said crushing chamber, said hinge axis being in a plane passing through said crushing chamber, said upper hinge section of said swing jaw being comprised of lateral support arms which straddle the opposed side panel structures of said stationary frame, and said side panel structures including opposed side plates each having an angled top edge which extends generally from said elevated hinge axis down to said stationary jaw whereby said top feed opening is generally defined by the top edges of said side plates, the top of said stationary jaw and the region between said lateral hinge supports.

* * * * *